US007104212B2

(12) United States Patent
Brianza

(10) Patent No.: US 7,104,212 B2
(45) Date of Patent: Sep. 12, 2006

(54) WIRELESS REMOTE CONTROLLER FOR YACHTS

(76) Inventor: Giuseppe Brianza, via Bellini, 31/33, 20095 Cusano Milanino (Milan) (IT)

( * ) Notice: Subject to any disclaimer, the term of this patent is extended or adjusted under 35 U.S.C. 154(b) by 105 days.

(21) Appl. No.: 10/915,756

(22) Filed: Aug. 11, 2004

(65) Prior Publication Data

US 2005/0126468 A1 Jun. 16, 2005

Related U.S. Application Data

(60) Provisional application No. 60/530,030, filed on Dec. 16, 2003.

(51) Int. Cl.
*B63H 25/00* (2006.01)
*G05D 1/02* (2006.01)

(52) U.S. Cl. ..... 114/144 RE; 114/382

(58) Field of Classification Search ..... 114/382, 114/144 E, 144 RE

See application file for complete search history.

(56) References Cited

U.S. PATENT DOCUMENTS

| | | | | |
|---|---|---|---|---|
| 4,614,900 | A | 9/1986 | Young | |
| 4,946,411 | A | 8/1990 | Novey | |
| 5,481,261 | A * | 1/1996 | Kanno | 340/870.16 |
| 5,725,402 | A | 3/1998 | Marsh | |
| 5,741,166 | A | 4/1998 | Newman | |
| 6,054,831 | A | 4/2000 | Moore | |
| 6,264,513 | B1 | 7/2001 | Marsh | |
| 6,431,930 | B1 | 8/2002 | Holt | |
| 6,508,190 | B1 | 1/2003 | Norton | |
| 6,520,105 | B1 | 2/2003 | Koda | |
| 6,655,309 | B1 | 12/2003 | Stephens | |
| 2003/0092331 | A1 | 5/2003 | Okuyama | |

FOREIGN PATENT DOCUMENTS

| | | |
|---|---|---|
| GB | 2374847 A | 10/2002 |
| JP | 62008899 | 1/1987 |
| JP | 06351075 | 12/1994 |
| WO | WO 93/23286 | 11/1993 |

* cited by examiner

*Primary Examiner*—Jesús D. Sotelo
(74) *Attorney, Agent, or Firm*—William H. Eilberg

(57) ABSTRACT

A wireless remote control system enables precise control of a yacht, or other vessel, from virtually any point on the yacht. A hand-held transmitter includes various switches for controlling the engines, thrusters, and/or anchor winch. A receiver, mounted on the yacht, receives signals from the transmitter. The receiver generates outputs that are connected to the existing electronic controls of the yacht. Thus, the receiver is connected in parallel with the conventional electronic controls of the yacht, and the system acts in addition to, and not instead of, the conventional control system. The system can thus be installed on existing vessels without modification of such vessels. An acoustic alarm signal is generated by the receiver when radio communication between the transmitter and receiver is severed.

18 Claims, 9 Drawing Sheets

DESCRIPTION OF THE TRANSMITTER

DESCRIPTION OF THE TRANSMITTER

DESCRIPTION OF THE RECEIVER

CONNECTION SCHEME OF THE RECEIVER

ADAPTER 12/24 V C.C.

CONNECTION SCHEME OF THE CONTROL LEVERS

CONNECTION OF THE BOW THRUSTER

CONNECTION OF THE STERN THRUSTER

CONNECTION SCHEME OF THE ANCHOR WINCH.

CONNECTION SCHEME OF THE EXTERNAL ACOUSTIC SIGNAL.

CONNECTION SCHEME OF THE EXTERNAL ACOUSTIC SIGNAL WITH RELAY

WIRELESS REMOTE CONTROLLER FOR YACHTS

CROSS-REFERENCE TO PRIOR APPLICATION

Priority is claimed from U.S. provisional patent application Ser. No. 60/530,030, filed Dec. 16, 2003, the entire disclosure of which is incorporated by reference herein.

BACKGROUND OF THE INVENTION

The present invention relates to the field of boating, and provides a hand-held, wireless device for remotely controlling the operation of a yacht or other marine vessel.

Owners and operators of boats are familiar with the problems associated with maneuvering a boat in a confined space. The problem is especially acute when the boat is in port or when mooring or docking. The person operating the controls may not be in the best location on the boat to monitor the movement and position of the boat relative to the dock. It is therefore usually necessary to seek assistance from another person, who is located either elsewhere on the vessel or on the dock. But difficulties often occur in communications between an operator at the helm, and persons located elsewhere on the boat, or on the dock. A failure of communication, or a miscommunication, can lead to damage to the vessel, or damage to nearby vessels. It can even cause injury to persons in the vicinity.

It has therefore been recognized, in the prior art, that the above-described problems could be ameliorated by providing a remote control device for the boat. If a boat can be controlled remotely, an unassisted operator could, in theory, control the boat while monitoring the position of the boat relative to the dock from a position offering greater visibility.

Various examples of such attempts at remote control are shown in the U.S. patent literature. U.S. Pat. No. 4,946,411 describes a hand-held remote control device for a boat, the device being connected, by a cable, to the outboard powerhead of the boat. Other examples of remote control, in the marine field, are given in U.S. Pat. Nos. 4,614,900, 5,725,402, 5,741,166, 6,264,513, 6,431,930, 6,508,190, and 6,520,105. Some of these patents describe wireless control devices, and some describe devices that are connected only by cables. The disclosures of all of the above-cited patents are hereby incorporated by reference herein.

None of the cited prior art provides a practical, compact, hand-held wireless remote control device that allows essentially full control over the operation of a yacht or other marine vessel. The present invention fills this need, making it easy for an unassisted person to perform tasks, such as mooring or docking, that otherwise would require additional crew members.

SUMMARY OF THE INVENTION

The present invention includes a wireless remote control system for a boat. The system works with boats that have been built with electronic controls. The electronic controls themselves therefore do not form part of the present invention.

The system includes a hand-held transmitter, and a receiver capable of receiving signals emitted by the transmitter. The transmitter includes a plurality of switches, for controlling the various components of the boat, such as the engines, the thrusters, and/or an anchor winch. When activated, the transmitter emits signals representative of the state of each switch, in a repeating cycle. The receiver is preferably mounted on a fixture of the boat, and is intended to be stationary. The receiver has outputs that become active when corresponding signals from the transmitter are received. The outputs of the receiver are connected to the existing electronic controls of the boat. In particular, the receiver outputs are connected in parallel with the conventional controls, so that the system of the present invention can act in addition to, but does not replace, the conventional control system provided with the boat.

The receiver includes, or is connected to, an acoustic transducer, or its equivalent, for sounding an alarm when radio communication between the transmitter and receiver is broken. This alarm alerts the user that the boat must be controlled conventionally, because the transmitter is not making contact with the receiver.

The system of the invention makes it possible for a user to control virtually any movement of the boat, while standing in virtually any location on the boat. Thus, the user can closely monitor a docking operation, for example, from the bow or stern of the boat, while still having precise control over the engines and thrusters. The result is that, in general, operations that usually require two or more persons with conventional systems, may be performed by one unassisted operator using the present invention.

The present invention has a further important advantage that it is easily installed on existing boats that are equipped with electronic controls, and does not require that the boats themselves be modified, other than by connecting the receiver to the electronic controls.

The present invention therefore has the primary object of providing a wireless remote control system for a yacht or other marine vessel.

The invention has the further object of providing a wireless remote control system for a yacht, wherein the system can control the engines, thrusters, and/or anchor winch of the boat.

The invention has the further object of enabling a boat to be precisely controlled, by wireless means, from a hand-held device.

The invention has the further object of reducing the number of crew members required to perform various tasks involving maneuvering of a boat.

The invention has the further object of providing a wireless remote control system which can be easily installed on existing boats without substantial modification of such boats.

The invention has the further object of providing a wireless remote control system for a boat, wherein the system works in parallel with the conventional controls of the boat, and does not supplant or replace those controls.

The invention has the further object of providing a wireless remote control system for a boat, wherein the system alerts the user when radio communication between a hand-held wireless remote control device, and a receiver, has been interrupted.

The reader skilled in the art will recognize other objects and advantages of the present invention, from a reading of the following brief description of the drawings, the detailed description of the invention, and the appended claims.

DETAILED DESCRIPTION OF THE INVENTION

The present invention includes a remote control system for use with a yacht or other marine vessel. When this specification uses the terms "yacht" or "boat", it should be understood that other marine vessels are included.

The invention includes two primary components, namely a wireless, hand-held transmitter, and a receiver which is mounted at or near the conventional controls of the yacht. The receiver is configured to receive signals from the transmitter, and to generate commands, in response to such signals, which commands control the operation of the yacht. The receiver outputs are connected essentially in parallel to the existing electronic controls of the yacht, so that the wireless transmitter does not supplant the existing controls. The system of the invention therefore allows the yacht to be controlled manually, in a conventional manner, i.e. by operating the levers that actuate the electronic controls, as well as by remote control through use of the hand-held unit.

Figure 1:
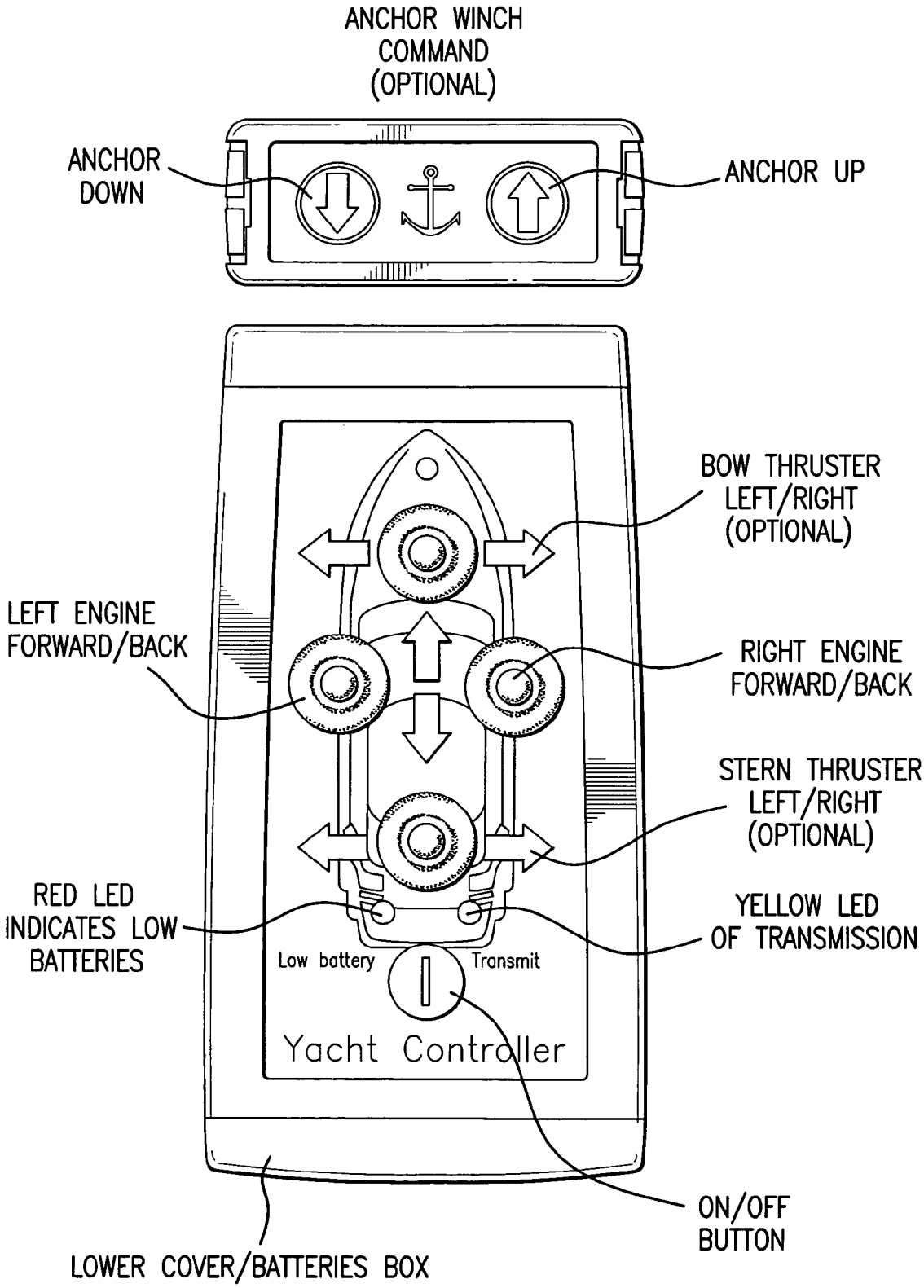
FIG. 1 provides a plan view of the hand-held transmitter unit which forms part of the present invention, and also shows an end view illustrating an optional control for an anchor winch.

FIG. 1 provides a plan view of a hand-held transmitter used in the present invention. The upper portion of FIG. 1 provides an end or front view, showing an optional control for an anchor winch. The transmitter includes one or more microprocessors (located inside the housing of the transmitter, and not visible in FIG. 1) which are programmed to emit a plurality of distinct signals that will be recognizable by a receiver. The range of the transmitter is intentionally limited, to minimize interference with other electronic devices in the vicinity. Moreover, in the preferred embodiment, the signal of the transmitter includes a digital code which is unique to the owner of the unit. The digital code can be pre-programmed at a factory.

As shown in the diagram of FIG. 1, the hand-held transmitter includes a plurality of switches for controlling the various functions of the yacht. The number of switches can vary, depending on what equipment is installed on the yacht, and on what is desired to be controlled. In the example given in FIG. 1, the yacht has left and right engines, and also has optional bow and stern thrusters. The illustrated device has one switch for each engine, and a single switch, which may be moved to the left or right, for each of the bow and stern thrusters. The device also may include switches to control an anchor winch, making it possible to pull an anchor up or to lay it down.

The electronic components of the transmitter are preferably housed in an ABS plastic container which provides some water resistance. The container preferably includes two sections which snap together. The transmitter is battery-powered, and the batteries can be replaced by separating the sections and gaining access to a battery box. Other means of powering the transmitter could be used instead, such as solar power.

The hand-held transmitter unit also includes two light-emitting diodes (LEDs). One LED illuminates when control signals are transmitted by the hand-held unit to the receiver, and also confirms the transmission of commands. The other LED illuminates when the available battery power falls below a predetermined level, and is a signal to the user to replace the batteries.

Figure 2:
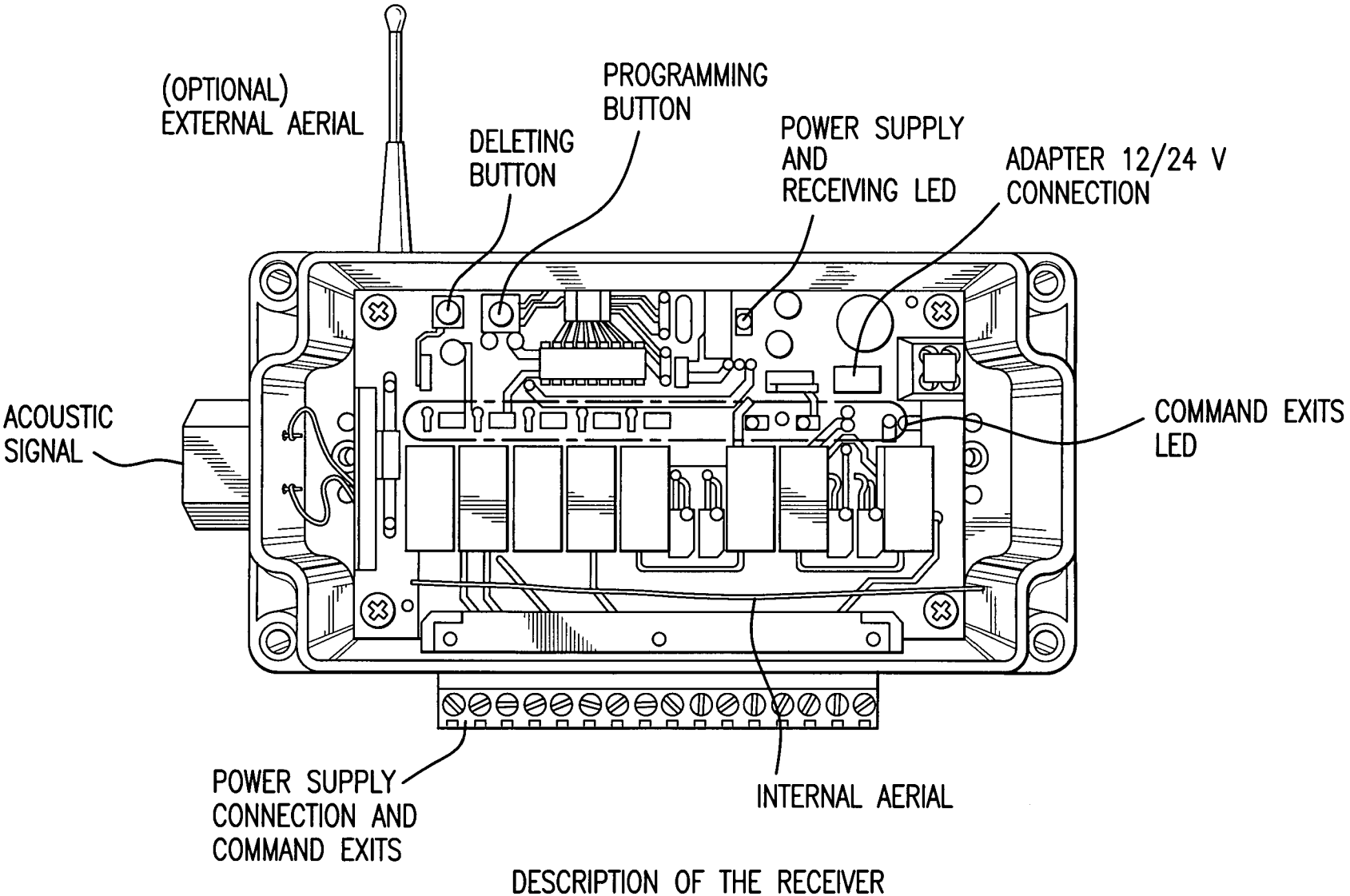
FIG. 2 provides a diagram of the interior of the receiver used in the present invention, and indicates its various connections and components.

The other major component of the present invention is a receiver for receiving and processing signals generated by the transmitter. The receiver unit is shown in FIG. 2. In the embodiment shown, the receiver is housed in a plastic container. The receiver is preferably mounted, using screws extending through screw holes, located at or near the corners of the receiver unit, and visible in both FIGS. 2 and 3, onto a fixture of the yacht, in a location that is out of view, but which does not prevent reception of signals from the transmitter. An internal antenna may be provided with the receiver, as shown. An optional external antenna may be connected to the receiver instead of the internal antenna, as is also indicated in the figure.

Figure 3:
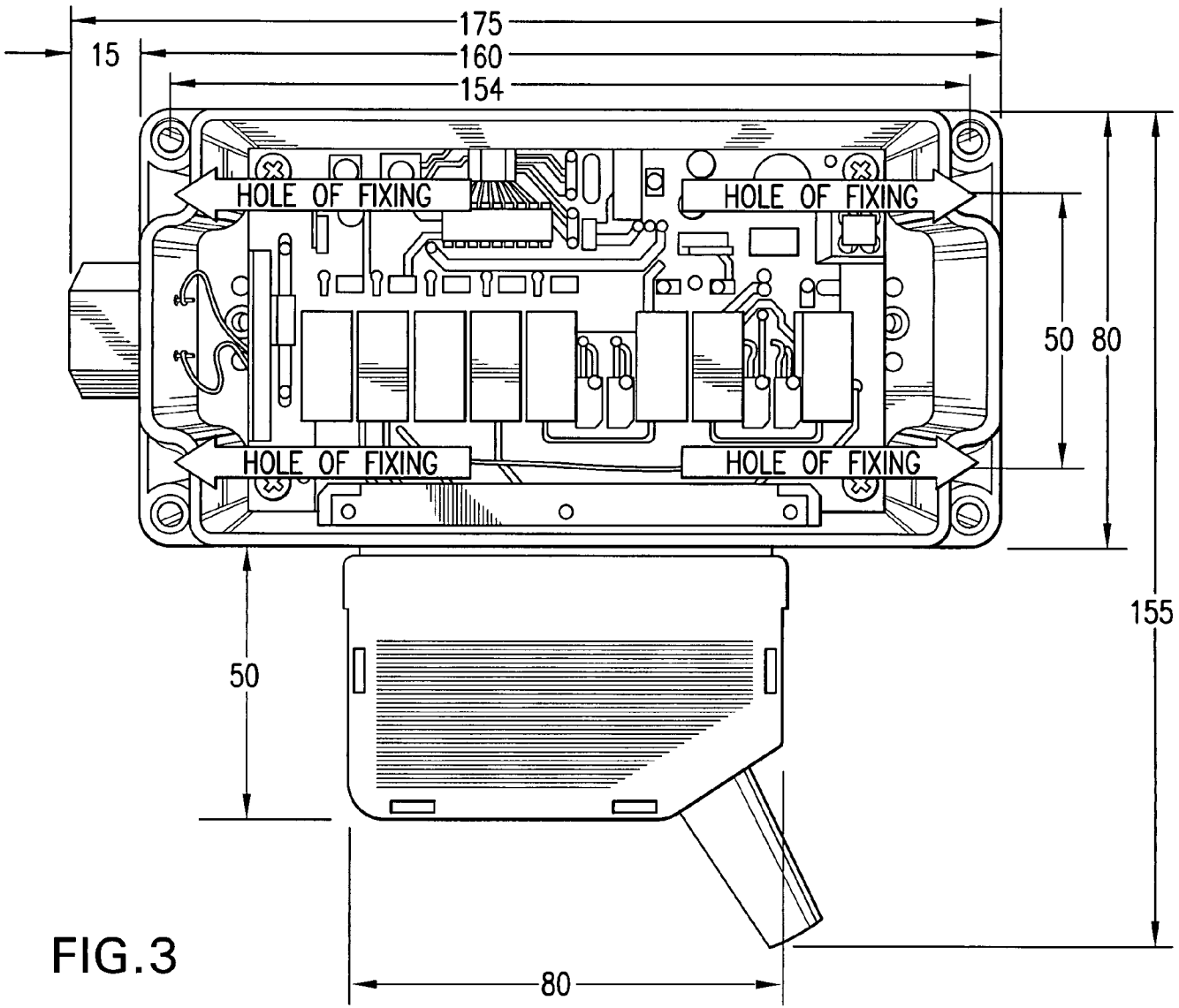
FIG. 3 provides another diagram of the receiver used in the present invention, showing the holes used for fastening the receiver to a boat, and also showing dimensions of a preferred embodiment.

FIG. 3 provides various dimensions, in millimeters, of a preferred embodiment. These dimensions are shown by way of example, and should not be deemed to limit the scope of the invention.

The present invention is intended for use only with yachts or boats that have electronic controls. Such systems include control levers or buttons, or their equivalents, that operate relays or switches which direct a control signal to a desired component, such as a motor. The system of the present invention works by generating commands that have the same effect, on the components of the boat, as the commands produced by operation of the conventional controls. Indeed, the commands produced by the remote control system are indistinguishable, to the systems of the boat, from commands produced conventionally.

It is an important feature of the invention that the outputs of the receiver be connected to actuate the conventional electronic controls of the boat without disturbing the function of these conventional controls. Thus, the outputs of the receiver, which appear along the connection strip labeled "power supply connection and command exits", in FIG. 2, are connected in parallel with the existing controls of the boat. Thus, the present invention can be used on existing boats, without the need to modify the existing circuitry provided on the boat.

Figure 4:
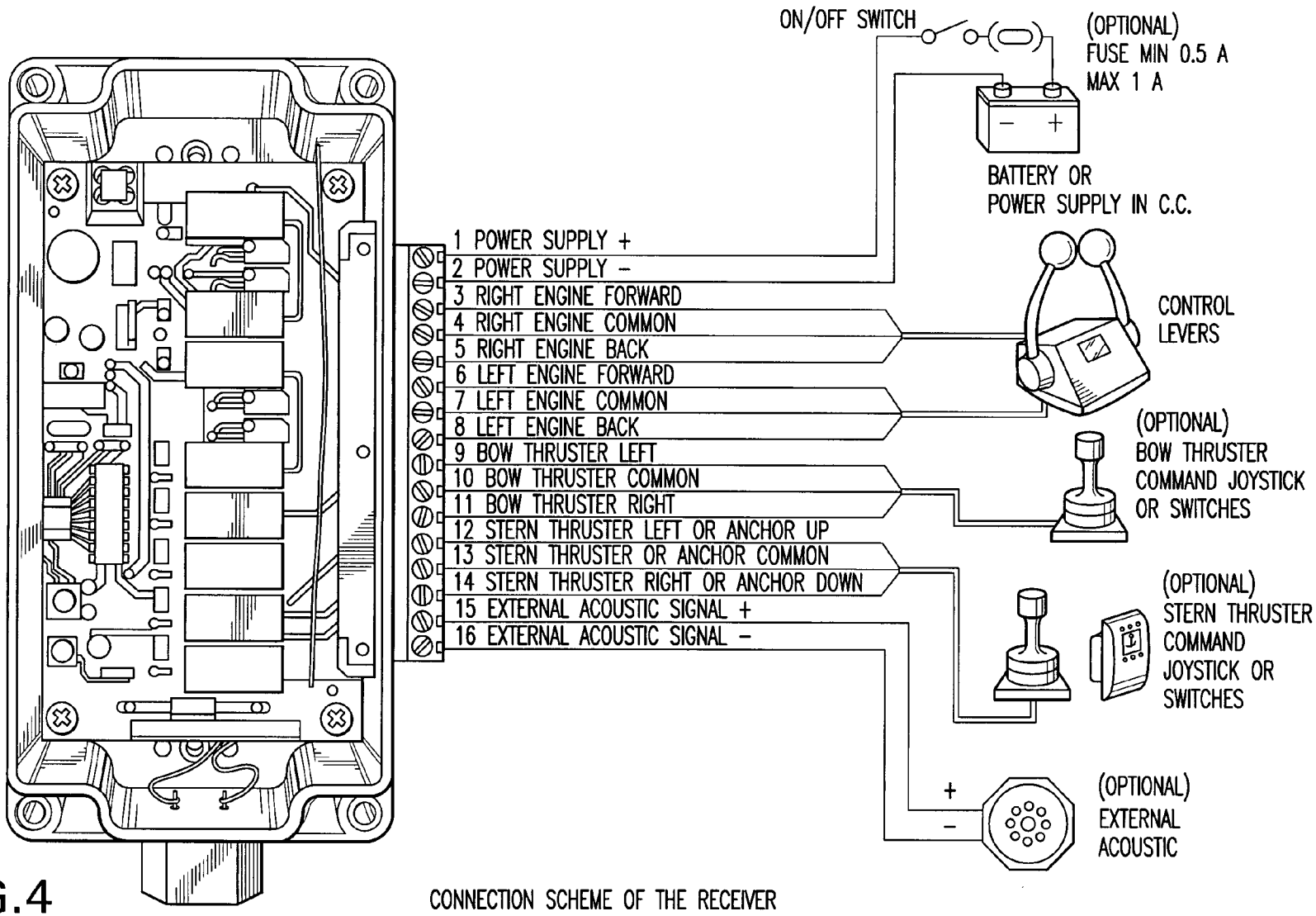
FIG. 4 provides a schematic diagram illustrating the connection of the outputs of the receiver to various control devices provided with the boat, as well as connections with a battery and acoustic transducer, according to the present invention.

More details about the connection of the outputs of the receiver, to the electronic controls of the boat, are provided in FIG. 4. This figure shows a strip of output terminals, on the receiver, and identifies the function of each terminal. On the right-hand side of the figure, there are represented the major control components of the boat, namely the engine control levers and the bow thruster joysticks (or equivalent switches). The figure also shows the connection to the battery that powers the receiver, and the acoustic transducer that produces a sound when the radio connection between the transmitter and receiver is broken.

Figure 5:
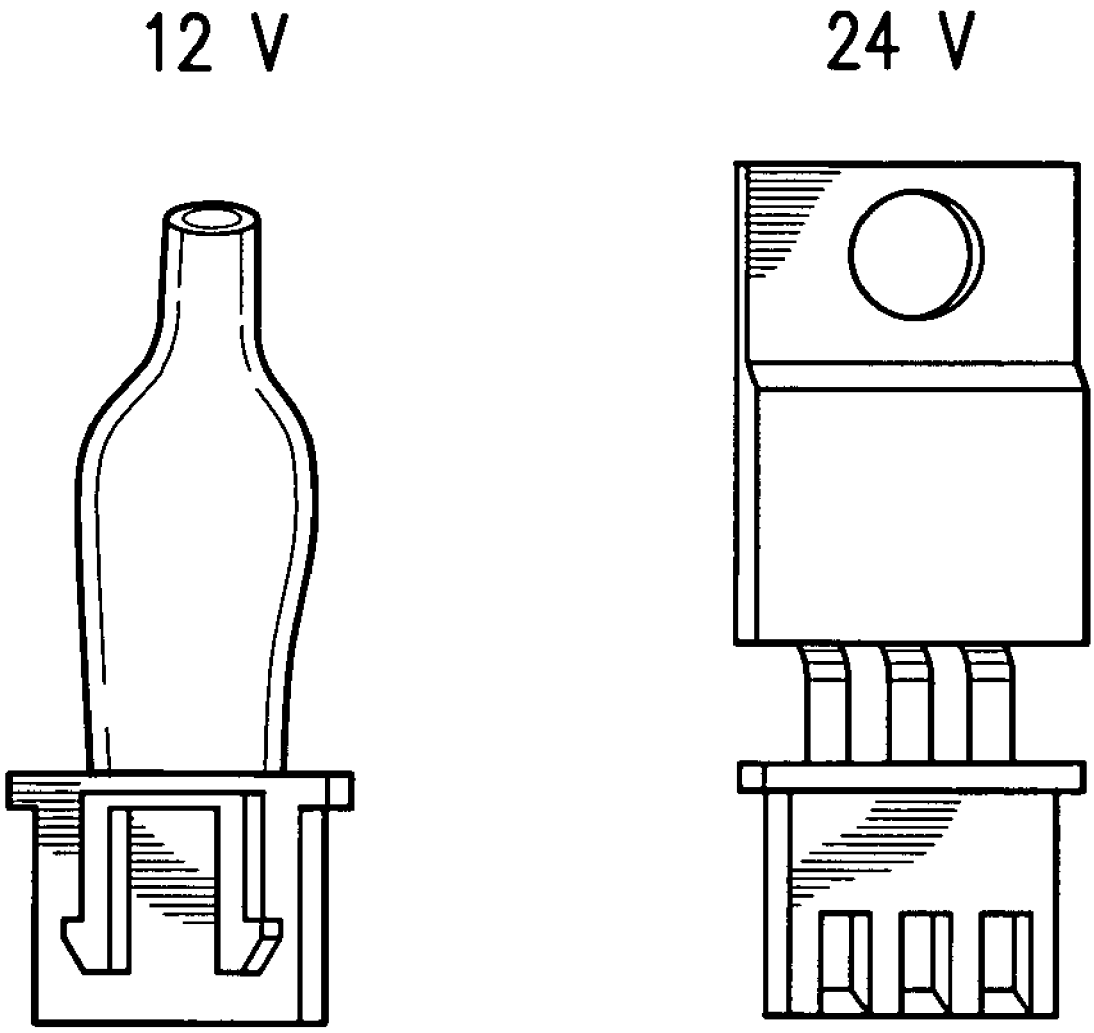
FIG. 5 provides a diagram showing adaptors for using the present invention on a boat having 12/24 VDC batteries.

FIG. 5 provides details of the adaptors that can be used for enabling the receiver to be used with either 12 volt or 24 volt batteries.

Figure 6:
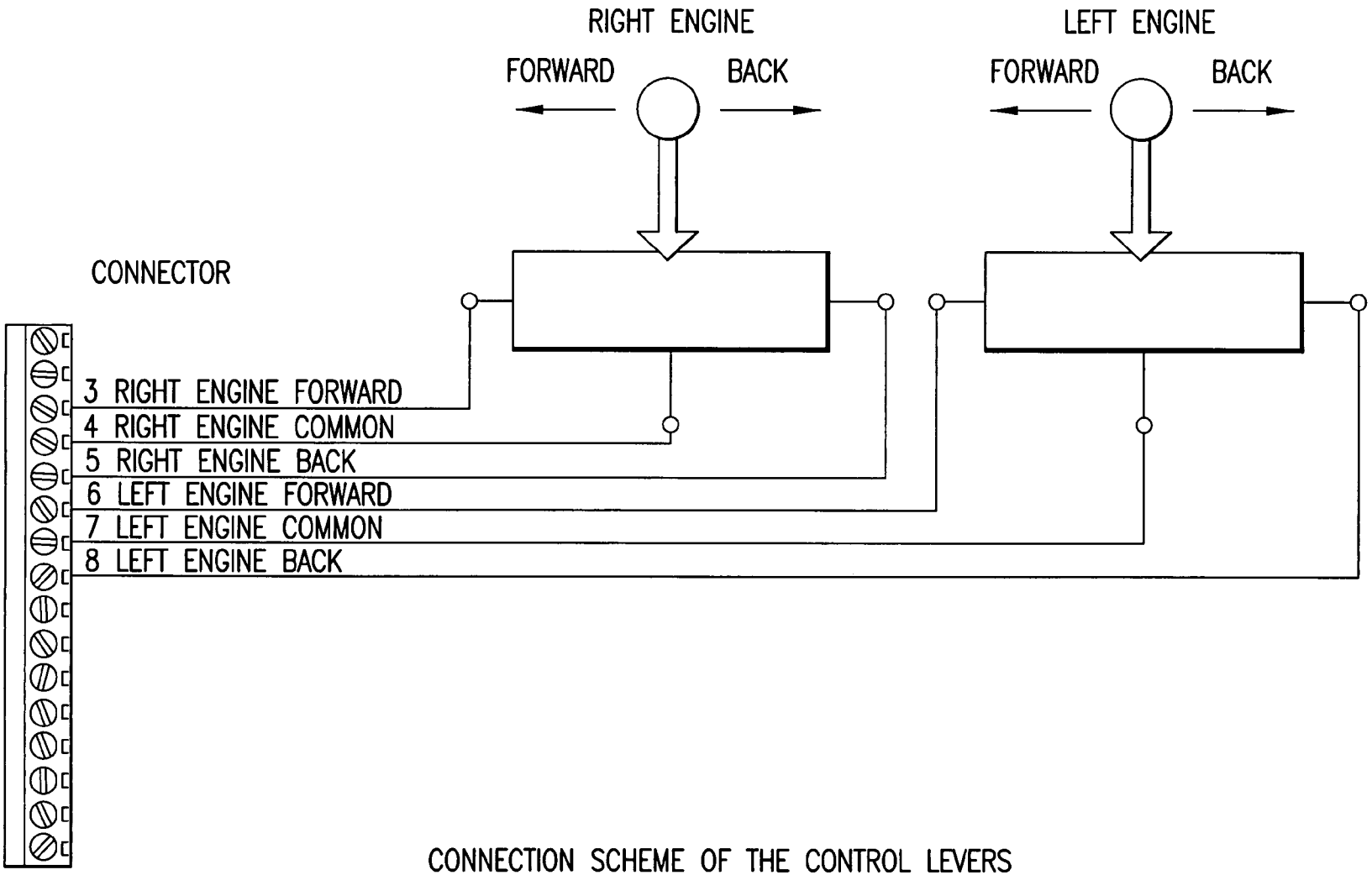
FIG. 6 provides a diagram showing the connection of the receiver, used in the present invention, to the control levers of the boat.
Figure 7:
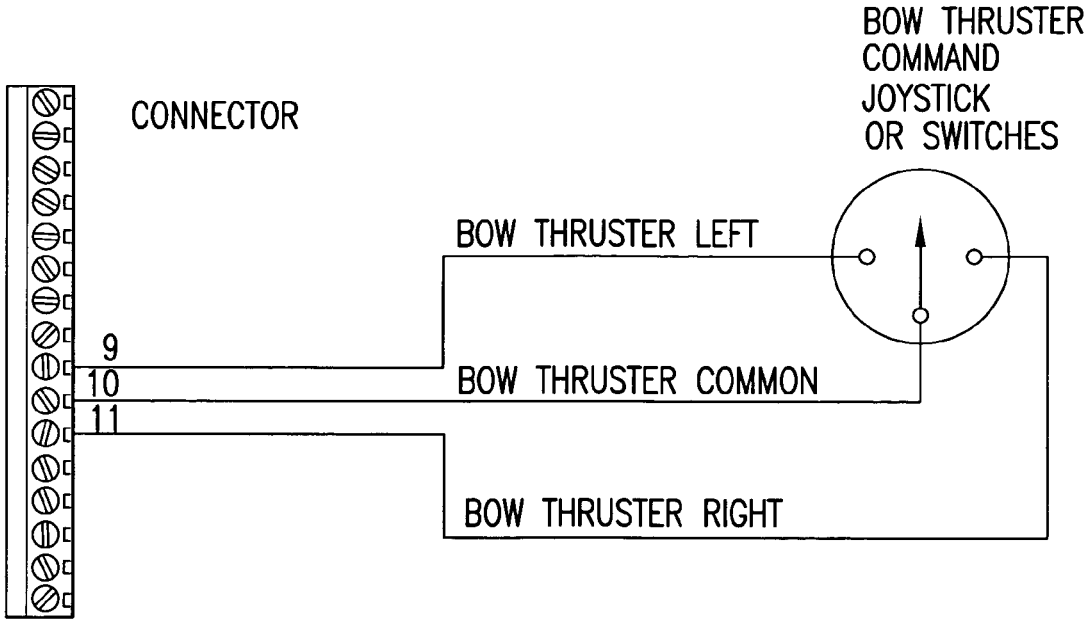
FIG. 7 provides a diagram showing the connection of the receiver, used in the present invention, to the bow thruster of the boat.
Figure 8:
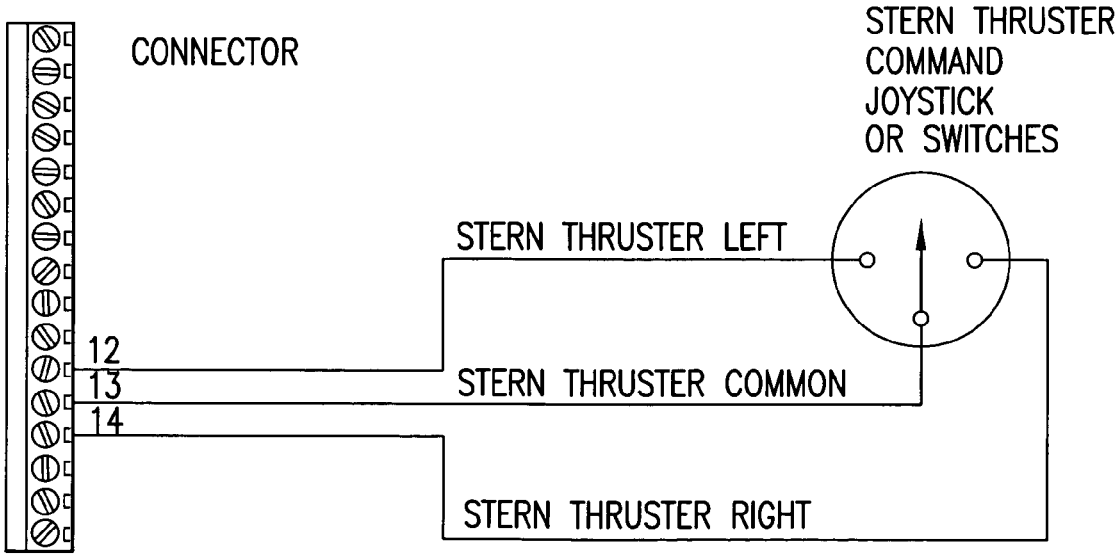
FIG. 8 provides a diagram showing the connection of the receiver, used in the present invention, to the stern thruster of the boat.
Figure 9:
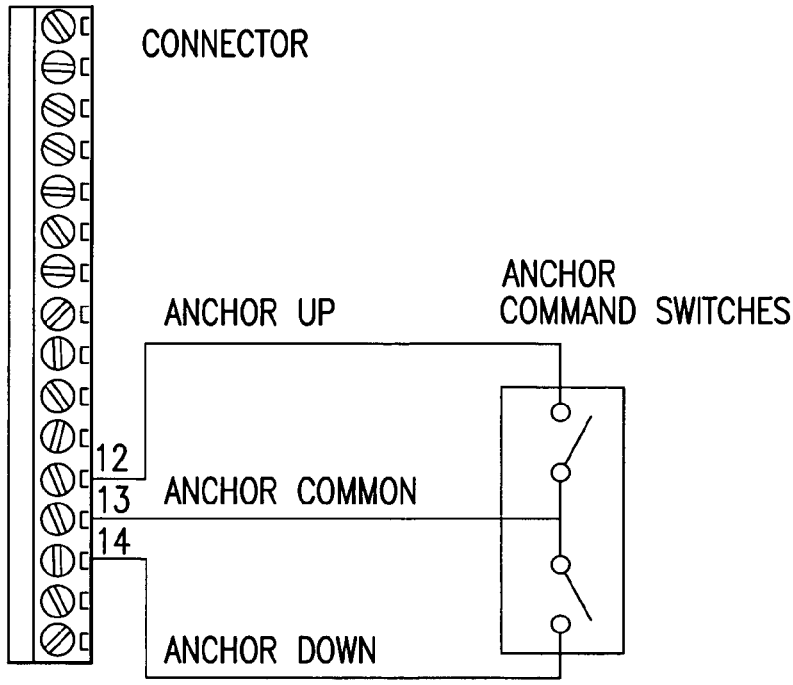
FIG. 9 provides a diagram showing the connection of the receiver, used in the present invention, to the anchor winch of the boat.

FIG. 6 provides additional details of the connection of the outputs of the receiver to the electronic engine controls. As stated earlier, these outputs are connected in parallel with the outputs of the conventional controls. FIGS. 7 and 8 provide similar details concerning the connection of the outputs of the receiver to the joysticks, or equivalent switches, that control the bow and stern thrusters, respectively. FIG. 9 provides similar details concerning the connection of the outputs of the receiver to the switches that control the anchor winch.

Note that in each case, the outputs of the receiver are not connected directly to the engines, thrusters, or winch, but rather are connected to the levers, joysticks, or the anchor winch command switch.

Figure 10:
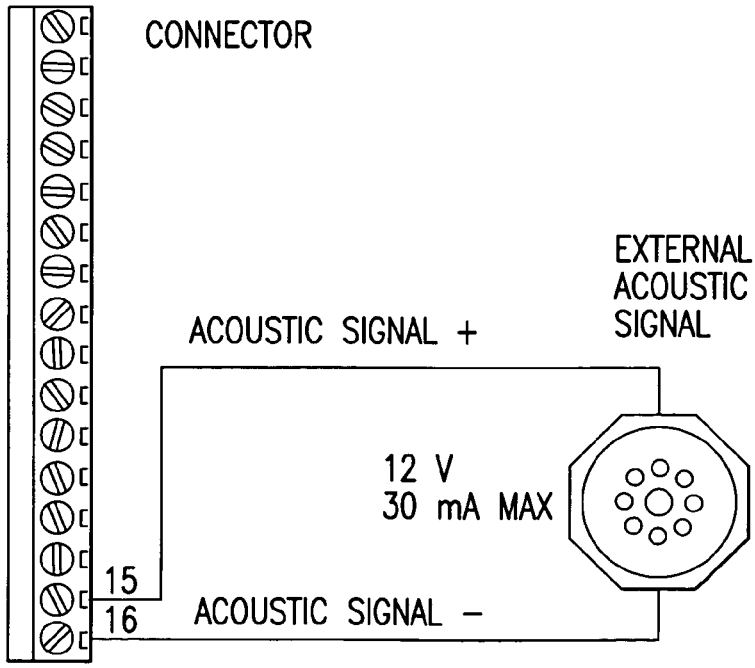
FIG. 10 provides a diagram showing the connection of the receiver, used in the present invention, to a device for generating an external acoustic signal.
Figure 11:
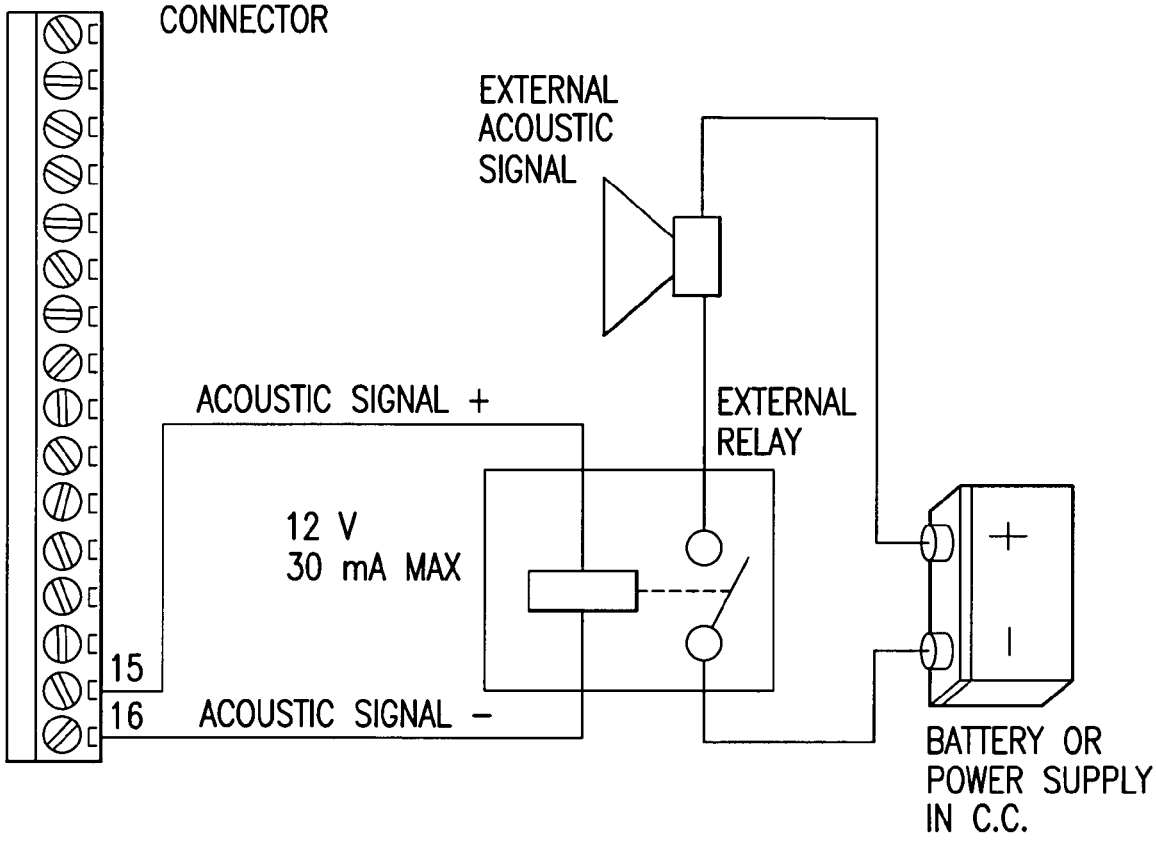
FIG. 11 provides a schematic diagram of an alternative arrangement for connecting the receiver to an acoustic transducer, wherein the transducer is controlled by an external relay.

FIG. 10 shows the details of the connection of the receiver to the transducer or other device that produces the acoustic signal. If the acoustic signal requires a current greater than 30 mA, the signal from the receiver should preferably be connected through a relay, as shown in FIG. 11.

The connection of the receiver outputs in parallel with the existing control lines is both a safety feature and a technical advantage of the present invention. It is a safety feature because the arrangement allows the conventional control levers to function normally, so that the operator can immediately resume conventional control of the boat, if necessary. It is a technical advantage because it allows the system to be installed on existing boats, without modification of the controls of the boat.

The receiver can be turned on by a separate switch which is preferably installed near the control station of the yacht. The receiver receives commands generated by the transmitter, and activates the functions of the boat according to the command received. It is possible to provide a receiver that can receive signals from more than one transmitter, as long as the transmitters do not operate simultaneously.

In the event of failure of communication between the transmitter and the receiver, the receiver automatically places the engines in a "neutral" setting, and activates an acoustic signal to warn the operator that communication with the transmitter has been lost.

When turned on, the transmitter automatically and continuously sends signals, to the receiver, the signals being representative of the state of the respective switches on the transmitter. A command remains "active" as long as its corresponding switch is actuated. In a preferred embodiment, the transmitter generates signals in a cyclical fashion, i.e. generating sequential signals that represent the state of each switch, and continuously repeating this sequence of signals.

The transmitter preferably includes, on the outside of its housing, a representation or other diagram of a boat, as illustrated in FIG. 1. This diagram assists the user in operating the switches. The switches or levers on the transmitter are located at positions, on that diagram, corresponding to the functions of each such switch. For example, the switches controlling the right and left engine are positioned at the right and left sides, respectively, of the diagram. The switches for the bow and stern thrusters are located, respectively, at the bow and stern of the boat represented by the diagram. It is therefore desirable that the operator of the transmitter hold the unit such that the bow of the boat shown on the unit points in the same direction as the bow of the actual boat. Failure to do so may cause confusion in operation, and may induce the operator to issue a command exactly opposite to what was intended.

The above arrangement is preferred. But notwithstanding the above, the system could be designed such that the transmitter controls are arranged in some other pattern, and not necessarily in the configuration of a boat.

The following paragraphs describe the operation of the system of the present invention.

Activation of the system of the invention is performed as follows. First, one starts the main engines in the usual manner. Then, one turns on the electronic control station, provided with the boat, and to which the receiver of the present invention is connected. At all times that the present invention is used, the levers, provided with the boat, for actuating the electronic controls must remain in the "neutral" position. Otherwise, there will be a conflict between the commands generated by movement of such levers, and commands generated by the hand-held transmitter. Next, one switches the receiver on, using a fixed switch installed at or near the receiver. In about two seconds, the receiver begins emitting its acoustic signal, indicating that the receiver is on but has not established radio contact with the transmitter.

One then turns the transmitter on, using the on-off button shown in the figures. The system is preferably programmed to require that the button be held down for about three seconds, to insure that the button is being pressed intentionally. The transmitter begins its periodic and repetitive transmission of signals to the receiver, the signals indicating the position of each switch on the transmitter. When the transmitter is transmitting, the LED showing transmission illuminates. Also, the receiver ceases to produce the acoustic signal, when the receiver and transmitter are communicating. When that acoustic signal stops, the system is ready to function. It is now possible to control the engines, thrusters, anchors, etc. simply by pressing the corresponding switches on the hand-held transmitter.

The transmitter is preferably programmed to turn itself off after passage of a predetermined time interval (such as four minutes) following the last actuation of any switch on the unit.

The transmitter is deactivated by pressing the on-off button for more than a predetermined interval (such as three seconds), so as to prevent accidental turn-off of the unit. When the unit is turned off, the transmission LED turns off, and the receiver produces its acoustic signal, caused by the severance of communication between the transmitter and receiver. The receiver is then deactivated by using its on-off switch.

Note that, in an emergency, it is possible to deactivate the system merely by turning off the on-off switch associated with the receiver, without turning the transmitter off. If the receiver is turned off, the commands from the transmitter cannot be received and executed.

The present invention allows an operator to achieve essentially full control of a boat, from any position on the boat. In particular, it is possible to control any of several engines or thrusters, and/or an anchor, provided that the boat includes circuitry for controlling these components electronically, and provided that an appropriate switch is provided on the transmitter. Because the transmitter is small, it can be held in the user's hand, or attached to the wrist, or suspended around the neck. By suspending the device from the neck, for example, the operator can use his or her hands to throw ropes and assist in mooring.

The following paragraphs describe the operation of the system in several typical uses:

1. Untying of the Boat

The user activates the system as described above. With the control levers in the neutral position, the user begins unmooring from the dock by going to the stern of the boat and releasing the lines holding the boat to the dock. Then, the user goes to the bow, and raises the anchor, using the control on the hand-held transmitter. The user thereby takes advantage of the essentially perfect visibility made possible by standing at the bow (or other point which is nearest the anchor), and can correct the movement of the boat with the help of the engines (or the bow and stern thrusters, if installed), to compensate for the effects of wind or wave motion.

At this point, the user may bring in the fenders, and may turn the system off, using the deactivation procedure described above. The user would then resume conventional control of the boat.

2. Tying the Stern to the Dock

Once inside the harbor, and with the control levers in the neutral position, the user activates the system as described above. After positioning the fenders and arriving in the vicinity of the assigned space for the boat, the user goes to the stern and begins the entrance maneuver with full visibility of the dock. During this maneuver, the user can operate the hand-held unit to make immediate corrections of the boat position, as required by effects of wind and wave motion.

The user then goes to the bow, and drops the anchor, using the hand-held unit, while taking care to advance the boat with a short engine forward command to avoid hitting the stern against the dock. At this point, it is possible to move to the stern and provide a short command to reverse the engines in order to tie the stern to the dock, with the assistance of persons on the dock, or with the assistance of a member of the crew.

Even in those cases where the boat does not have an electric winch, the process of raising or lowering the anchor can be greatly simplified by the use of short commands to the engines, causing the boat to move forward or backward, thereby controlling the tension in the lines.

The system can then be deactivated as described above.

3. Dropping the Anchor

Once the user has selected the desired position for the anchorage, the user places the control levers in the neutral position, and activates the system as described above. The user goes to the bow and, after checking the depth of the water, and after checking for the possible presence of other anchors or chains, controls the descent of the anchor using the anchor control on the transmitter. After lowering the anchor to the proper depth, and providing the necessary amount of line or chain, the user operates the transmitter to reverse the engines, to check the hold on the bottom and the direction of the anchor chain. When the maneuver is completed, the user deactivates the system as described above.

4. Weighing Anchor

The user places the control levers in their neutral positions, and activates the system as described above. The user goes to the bow to check that the line or chain freely rises, and uses short commands to the anchor winch to avoid excessive tension on the winch. Once the anchor is raised, the system is deactivated as described above.

5. Hooking to a Mooring Buoy

The user places the control levers in their neutral positions, and activates the system as described above. Unlike the conventional procedure wherein a person must stand near the bow with a boat hook to catch the mooring buoy, the user maneuvers the boat with the hand-held unit, and is able to pick up the buoy at the stern. From this position, it is easy to tie to the buoy and walk the line to the bow to secure it to the forward cleat. Upon completion of this procedure, the system can be deactivated as described above.

6. Unhooking from a Mooring Buoy

The user places the control levers in their neutral positions, and activates the system as described above. The user then goes to the bow, and releases the line from the cleat, and slips it off from the buoy. The user operates the hand-held transmitter to provide short commands to the engines, to counteract the drift of the boat due to wind, and thereby to avoid collisions with other boats. The system can then be deactivated as described above.

In addition to the above-described situations, the system of the invention can be useful in many other scenarios. For example, when the boat is being tied to a dock, to refuel or to obtain supplies, especially in restricted spaces, it is easy to control the boat from points of maximum visibility, using the hand-held transmitter, without risking collisions, and without having to shout at crew members for assistance.

Also, when the boat is in shallow water, or near submerged rocks or other obstacles, the operator can control the boat accurately from either the bow, the sides, or the stern, thereby preventing damage to propellers, shafts, and other underwater components, and reducing the risk of becoming stranded.

Also, when docking the boat, or when approaching another boat, the operator can control the boat from the sides, or from the stern or the bow. The user can position himself in the location that is best for estimating the distance to the dock or to another boat, thus enhancing the accuracy of the maneuver.

In still another example, the present invention enables an unassisted user to pick up a buoy, by maneuvering the boat, with precision, alongside the buoy.

The present invention therefore enables the essential functions of a boat to be controlled from virtually any position on the boat. The operator can position himself so as to have the best possible view of the dock, or of the anchor, but can still control the boat as if he were located at the control station.

The invention can be modified in many ways. The number of switches on the hand-held unit can be varied according to the number of electronically controllable components provided with the boat. Thus, for boats having only one engine, the hand-held transmitter could have as few as one switch or lever. For boats having two engines but no thrusters, the control device could have only switches to control the engines, and the switches for thrusters could be omitted. The receiver can be installed in a variety of locations on the boat, though preferably not in the engine room, to avoid thermal or mechanical damage. A major determinant of the location of the receiver is the ability of the operator to hear the acoustic signal from the receiver. It is possible to provide a source of acoustic energy originating in a location different from that of the receiver. These and other modifications, which will be apparent to those skilled in the art, should be considered within the spirit and scope of the following claims.

What is claimed is:

1. A wireless remote control system for a boat, the boat being provided with at least one electronic control, the system comprising:

a) a hand-held transmitter, and b) a receiver, wherein the transmitter is capable of generating a signal that is detectable by the receiver without wired connection between the transmitter and receiver, wherein the receiver has at least one output which is operatively connected to said at least one electronic control of the boat, wherein the boat has at least one manual control, the manual control being connected to operate the electronic control, and wherein the receiver is connected to operate a same electronic control operated by the manual control.

2. The system of claim 1, wherein the output of the receiver is connected in parallel with an output of said electronic control, wherein the transmitter does not supplant existing controls of the boat.

3. The system of claim 1, wherein the receiver includes means for actuating an alarm when wireless communication between the transmitter and the receiver is broken.

4. The system of claim 1, wherein the transmitter includes switches which control all available engines of the boat.

5. The system of claim 4, wherein the transmitter includes a switch for controlling an anchor winch mounted on the boat.

6. The system of claim 1, wherein the transmitter includes a housing which contains a diagram of a boat, and wherein the transmitter includes at least one control that is positioned to correspond to a component of the boat to be controlled.

7. The system of claim 1, wherein the boat has a plurality of engines, and a plurality of electronic controls, and wherein all of the engines of the boat are controlled by respective electronic controls.

8. In a boat having at least one electronic control, the electronic control including a manually operated control, the manually operated control being electrically connected to said at least one electronic control for controlling a component of the boat, the improvement comprising a wireless remote control device, the remote control device including a transmitter and a receiver, the receiver being connected to operate a same electronic control operated by said manually operated control, the transmitter being capable of emitting a signal that causes said receiver to control said component.

9. The improvement of claim 8, wherein both the transmitter and the manually operated control device remain simultaneously operative to control said component.

10. The improvement of claim 8, wherein the receiver includes means for actuating an alarm when wireless communication between the transmitter and the receiver is broken.

11. The improvement of claim 8, wherein the transmitter includes a housing which contains a diagram of a boat, and wherein the transmitter includes at least one control that is positioned to correspond to a component of the boat to be controlled.

12. The improvement of claim 8, wherein the boat has a plurality of engines, and a plurality of electronic controls, and wherein all of the engines of the boat are controlled by respective electronic controls.

13. A method of adapting a boat for use with a wireless remote control device, the boat including at least one electronic control and a lever for actuation of the electronic control, the method comprising mounting a receiver on a fixture of the boat, the receiver being capable of receiving a signal from a transmitter that has no wired connection with the receiver, and connecting an output of the receiver to operate a same electronic control which is operated by said lever, wherein a signal generated by the receiver causes a response by said electronic control, wherein said response is indistinguishable from a response caused by actuation of said lever.

14. The method of claim 13, wherein the connecting step comprises connecting the output of the receiver in parallel with an output of the lever.

15. The method of claim 13, wherein the boat is selected to have a plurality of engines and a plurality of electronic controls, and wherein the method further comprises connecting the receiver to each of said electronic controls, wherein said plurality of engines can be controlled by a signal from the receiver.

16. A method of modifying a boat so as to enable remote control of the boat, the boat having a manual control having an output connected to operate an electronic control, the method comprising:

connecting an output of a receiver to a same electronic control which is operated by said manual control, wherein the connecting step is performed without disturbing a connection between the manual control and the electronic control, wherein a signal generated by the receiver acts in parallel with a signal from said manual control.

17. The method of claim 16, further comprising the step of mounting the receiver to the boat.

18. The method of claim 16, wherein the boat is selected to have a plurality of engines and a plurality of electronic controls, and wherein the method further comprises connecting the receiver to each of said electronic controls, wherein said plurality of engines can be controlled by a signal from the receiver.

* * * * *